US011643953B2

(12) United States Patent
Mettenleiter et al.

(10) Patent No.: US 11,643,953 B2
(45) Date of Patent: May 9, 2023

(54) EXHAUST MUFFLER FOR AN EXHAUST SYSTEM OF AN INTERNAL COMBUSTION ENGINE

(71) Applicant: Purem GmbH, Neunkirchen (DE)

(72) Inventors: Nicolas Mettenleiter, uml o+ee ngen (DE); Thomas Uhlemann, Esslingen (DE); Frank Berkemer, Eningen (DE)

(73) Assignee: PUREM GMBH, Neunkirchen (DE)

( * ) Notice: Subject to any disclaimer, the term of this patent is extended or adjusted under 35 U.S.C. 154(b) by 229 days.

(21) Appl. No.: 16/864,592

(22) Filed: May 1, 2020

(65) Prior Publication Data

US 2020/0347761 A1 Nov. 5, 2020

(30) Foreign Application Priority Data

May 2, 2019 (DE) ..... 10 2019 111 270.2

(51) Int. Cl.
*F01N 1/02* (2006.01)

(52) U.S. Cl.
CPC ..... *F01N 1/023* (2013.01); *F01N 1/02* (2013.01); *F01N 2470/02* (2013.01); *F01N 2490/04* (2013.01); *F01N 2490/15* (2013.01)

(58) Field of Classification Search
CPC .... F01N 1/02; F01N 2470/02; F01N 2490/15; F01N 2490/02; F01N 1/023; F01N 1/083; F01N 2490/155; G10K 11/172
USPC ..... 181/228
See application file for complete search history.

(56) References Cited

U.S. PATENT DOCUMENTS

| | | | | |
|---|---|---|---|---|
| 3,434,565 | A | 3/1969 | Fischer | |
| 4,111,279 | A * | 9/1978 | Sterrett | F01N 1/02 181/275 |
| 4,359,135 | A * | 11/1982 | Wagner | F01N 1/02 181/266 |
| 4,645,031 | A * | 2/1987 | Omura | F01N 1/06 181/266 |
| 2007/0102236 | A1 | 5/2007 | Uhlemann et al. | |
| 2012/0097478 | A1* | 4/2012 | Keck | F01N 1/22 181/228 |
| 2012/0273299 | A1* | 11/2012 | Jones | F01N 1/084 181/228 |

(Continued)

FOREIGN PATENT DOCUMENTS

| | | | |
|---|---|---|---|
| AT | 13947 | U1 | 1/2015 |
| CN | 102278171 | A | 12/2011 |

(Continued)

OTHER PUBLICATIONS

English translation of Korean Patent Application Publication No. KR 20100005982 A (2010) (Year: 2010).*

*Primary Examiner* — Jonathan R Matthias
(74) *Attorney, Agent, or Firm* — McGlew and Tuttle, P.C.

(57) ABSTRACT

An exhaust muffler for an exhaust system of an internal combustion engine, especially for a vehicle, includes a muffler housing with a flow volume (42), through which exhaust gas can flow, an exhaust gas inlet (28) and an exhaust gas outlet (36). A first resonator chamber (44) is open towards the flow volume (42) via a first resonator neck (68). A second resonator chamber (46) is open towards the flow volume (42) via a second resonator neck (74). A resonator pipe (52) provides the first resonator neck (68) and the second resonator neck (74).

15 Claims, 1 Drawing Sheet

(56) References Cited

U.S. PATENT DOCUMENTS

| | | | | |
|---|---|---|---|---|
| 2012/0273301 | A1* | 11/2012 | Jones | F01N 13/1838 181/228 |
| 2013/0213734 | A1* | 8/2013 | Ahn | F01N 1/023 181/256 |
| 2014/0041959 | A1* | 2/2014 | Won | F01N 1/084 181/256 |
| 2017/0218806 | A1* | 8/2017 | LeRoy | F01N 1/023 |
| 2017/0276043 | A1* | 9/2017 | Khan | F01N 3/0335 |
| 2019/0178124 | A1* | 6/2019 | Ostromecki | F01N 1/083 |

FOREIGN PATENT DOCUMENTS

| | | | | |
|---|---|---|---|---|
| CN | 102536386 | A | | 7/2012 |
| CN | 102588166 | A | | 7/2012 |
| CN | 105386843 | A | | 3/2016 |
| CN | 106194367 | A | | 12/2016 |
| CN | 106640274 | A | | 5/2017 |
| CN | 107420170 | A | | 12/2017 |
| DE | 102005054002 | A1 | | 5/2007 |
| DE | 102008022123 | A1 | | 6/2009 |
| EP | 3098413 | A1 | | 11/2016 |
| GB | 1443652 | A | | 7/1976 |
| GB | 2199076 | A | | 6/1988 |
| JP | H09236008 | A | | 9/1997 |
| JP | H09250327 | A | | 9/1997 |
| JP | H1030424 | A | | 2/1998 |
| JP | H10299473 | A | | 11/1998 |
| JP | 2005240633 | A | | 9/2005 |
| JP | 2007064020 | A | | 3/2007 |
| KR | 100311132 | B1 | * | 11/2001 |
| KR | 20100005982 | A | * | 1/2010 |
| KR | 20110037576 | A | | 4/2011 |
| WO | 2009009120 | A1 | | 1/2009 |
| WO | 2017144266 | A1 | | 8/2017 |

* cited by examiner

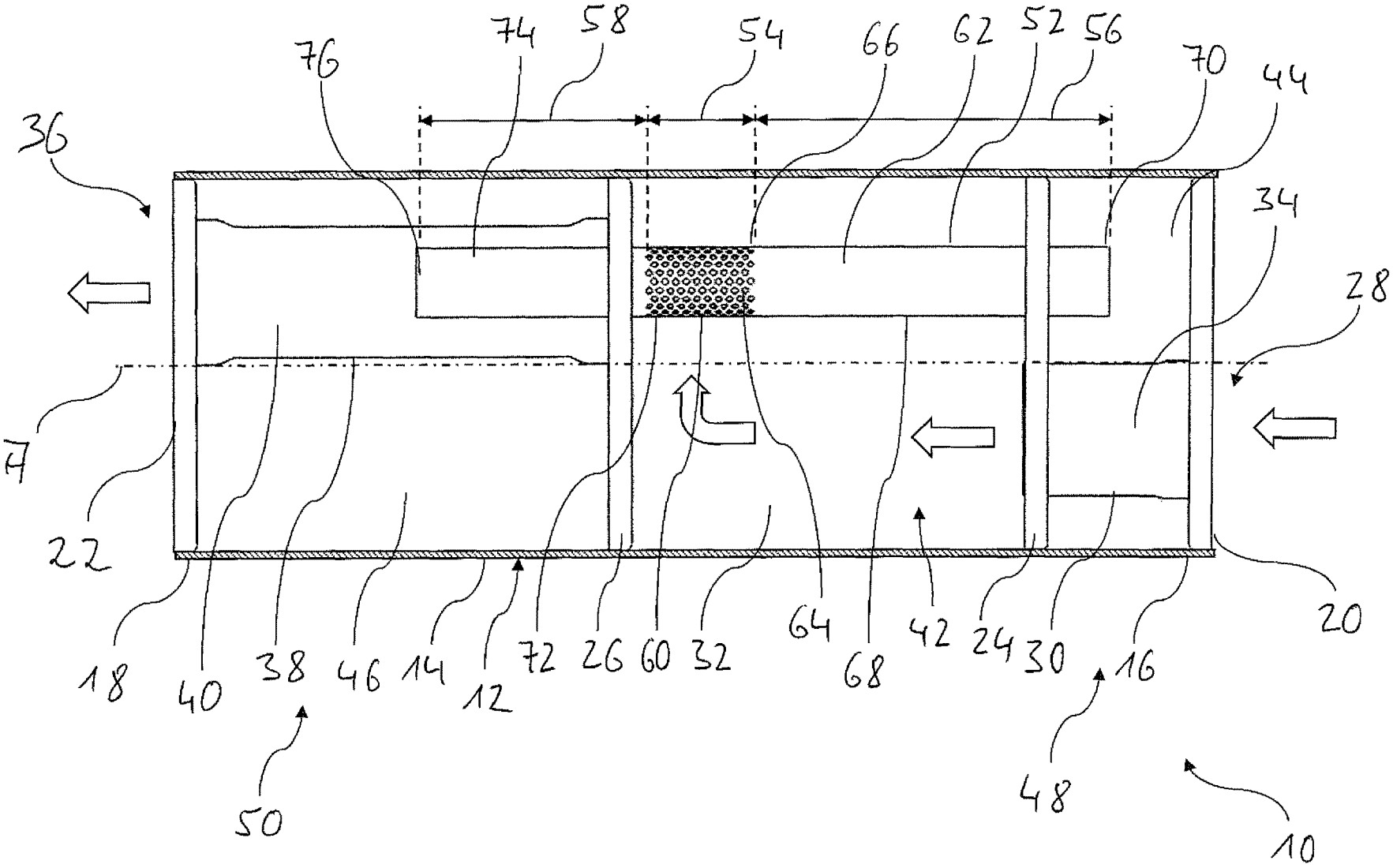
10
12
14
16
18
20
22
24
26
28
30
32
34
36
38
40
42
44
46
48
50
52
54
56
58
60
62
64
66
68
70
72
74
76
H

EXHAUST MUFFLER FOR AN EXHAUST SYSTEM OF AN INTERNAL COMBUSTION ENGINE

CROSS REFERENCE TO RELATED APPLICATIONS

This application claims the benefit of priority under 35 U.S.C. § 119 of German Application 10 2019 111 270.2, filed May 2, 2019, the entire contents of which are incorporated herein by reference.

TECHNICAL FIELD

The present invention pertains to an exhaust muffler for an exhaust system of an internal combustion engine.

TECHNICAL BACKGROUND

It is known that Helmholtz resonators are integrated in such exhaust mufflers in order to make it possible to influence the muffling characteristic of exhaust mufflers. Such a Helmholtz resonator comprises in an exhaust muffler a resonator volume in a resonator chamber, which resonator volume is generally basically closed, i.e., no exhaust gas stream passed through the exhaust muffler flows through it, wherein said resonator chamber is open via a resonator neck to the flow volume, through which the exhaust gas stream flows, in the interior of a muffler housing. Adaptation to especially critical or relevant frequencies to be muffled can be carried out by the suitable selection of the volume of the resonator chamber and of the dimension of the resonator neck, especially of the cross-sectional area of an opening of the resonator neck and of the length of the resonator neck.

SUMMARY

An object of the present invention is to provide an exhaust muffler for an exhaust system of an internal combustion engine, especially in a vehicle, which exhaust muffler provides a broad muffling spectrum with a structurally simple configuration.

This object is accomplished according to the present invention by an exhaust muffler for an exhaust system of an internal combustion engine, especially in a vehicle, comprising in a muffler housing:

- a flow volume, through which exhaust gas can flow, with an exhaust gas inlet and with an exhaust gas outlet,
- a first resonator chamber, which is open to the flow volume via a first resonator neck,
- a second resonator chamber, which is open to the flow volume via a second resonator neck, and
- a resonator pipe providing the first resonator neck and the second resonator neck.

Two Helmholtz resonators can be built with a single resonator pipe in an exhaust muffler configured according to the present invention, wherein each of these two Helmholtz resonators can be tuned by suitable dimensioning to an especially critical frequency, i.e., the two Helmholtz resonators can consequently be provided with different resonance frequencies. This leads to a muffling spectrum expanded by the use of two Helmholtz resonators with a configuration that can be embodied in a technically simple manner and requires a small number of components.

The muffler housing may have a circumferential wall elongated in the direction of a housing longitudinal axis and a front wall each at both axial end areas of the circumferential wall as well as at least two partitions between the front walls, wherein the first resonator chamber is separated by a first partition from the flow volume and the second resonator chamber is separated by a second partition from the flow volume. It should be noted in this connection that the flow volume shall be considered in the sense of the present invention as the volume through which the exhaust gas flows in the interior of the muffler housing and which is provided in one or more chambers and through which the exhaust gas stream flows. The volume of the resonator chambers, which is basically open to this flow volume via the resonator necks and into which exhaust gas can basically also enter via the associated resonator neck, is nevertheless not a part of this flow volume.

The flow volume may comprise a flow chamber formed between the first partition and the second partition. This flow chamber may be the only chamber, which is provided in the interior of the muffler housing and through which exhaust gas stream to be passed through the exhaust muffler can flow. It is also possible, however, to provide a plurality of chambers, which communicate with one another via pipes and/or via partitions configured with openings, and through which the exhaust gas stream can flow.

To provide a connection of the resonator chambers to the flow volume, it is proposed that the first resonator neck pass through the first partition or/and be open to the first resonator chamber in the area of the first partition, and that the second resonator neck pass through the second partition or/and be open to the second resonator chamber in the area of the second partition. In order to make it possible in this case to efficiently use the volumes of the resonator chambers for the Helmholtz resonators to be provided thereby, provisions are further preferably made for the first partition not to have an opening providing a connection between the flow volume and the first resonator chamber in addition to the opening provided by the first resonator neck and for the second partition not to have an opening providing a connection between the flow volume and the second resonator chamber in addition to the opening provided by the second resonator neck.

In order to make it possible in the case of a configuration with a single resonator pipe for two Helmholtz resonators to provide a connection of the resonator necks provided by this resonator pipe with the flow volume, it is proposed that the resonator pipe have at least one pipe wall opening establishing a connection between the flow volume and a pipe interior of the resonator pipe in a pipe wall of the resonator pipe in its section extending in the flow volume. In particular, provisions may be made in this connection for the resonator pipe to have an opening section with a plurality of pipe wall openings in its section extending in the flow volume.

The effect of the resonator pipe provided in association with two Helmholtz resonators as two resonator necks can be achieved, for example, by the resonator pipe providing the first resonator neck in a first length area adjoining the opening section at a first axial end area of the opening section and by providing the second resonator neck in a second length area adjoining the opening section at a second axial end area of the opening section.

For a compact configuration, the first resonator chamber may be formed between one of the two front walls and the first partition, and the second resonator chamber may be formed between the other of the two front walls and the second partition.

Such a compact configuration may be supported by the resonator pipe passing through the flow chamber and being open with a first axial end area to the first resonator chamber or/and by being located in the first resonator chamber and by being open towards the second resonator chamber with a second axial end area or/and by being located in the second resonator chamber and by the resonator pipe having the at least one pipe wall opening in its section extending in the flow chamber.

In order to make it possible to introduce the exhaust gas stream to be passed through the exhaust muffler into said exhaust muffler and to remove it again from this, it is proposed that the exhaust gas inlet comprise an inlet pipe that is open in the area of one of the two front walls and comprise an inlet pipe providing an inlet duct, and that the exhaust gas outlet comprise an outlet pipe that is open in the area of the other of the two front walls and provide an outlet duct.

To obtain a flow connection with the flow volume or with the flow chamber providing this or an essential part thereof, the inlet pipe may be passed through one of the two resonator chambers, and the outlet pipe may be passed through the other of the two resonator chambers. Provisions may be made in this connection, in particular, for neither the inlet pipe nor the outlet pipe to be open, so that the resonator chambers have, indeed, a connection to the flow volume only through the respective resonator necks associated with these.

Further, the inlet pipe may be open to the flow volume in the area of the partition separating one of the two resonator chambers from the flow volume, and the outlet pipe may be open to the flow volume in the area of the housing partition separating the other of the two resonator chambers from the flow volume.

In order to make possible the interaction of the resonator pipe provided in association with two Helmholtz resonators with a simple configuration, the first resonator chamber, which is formed between one of the two front walls and the first partition, the flow chamber formed between the first partition and the second partition, and the second resonator chamber formed between the second partition and the other of the two front walls may be provided following each other in the direction of the housing longitudinal axis.

In the exhaust muffler according to the present invention, the two Helmholtz resonators, which are provided in it and interact with and are configured with a single resonator pipe, can be tuned to different resonance frequencies in a simple manner by the first resonator chamber and the second resonator chamber having mutually different resonator chamber volumes or/and by the first resonator neck and the second resonator neck having mutually different resonator neck lengths. The resonator pipe could basically also have different cross-sectional dimensions in the areas in which the resonator pipe provides the two resonator necks in order also to influence thereby the resonance frequencies or to be able to provide different resonance frequencies. It is nevertheless proposed for a configuration that can be embodied in a structurally especially simple manner that the resonator pipe have a constant cross-sectional dimension over its entire length, because especially the selection of the length of the resonator necks offers a markedly simpler possibility of influencing the resonance frequencies in the context of the configuration of the resonator pipe.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a sectional view of an exhaust muffler shown in the open state.

DESCRIPTION OF PREFERRED EMBODIMENTS

Referring to the drawings, an exhaust muffler is generally designated by 10 in FIG. 1. The exhaust muffler 10 comprises a muffler housing 12 with a circumferential wall 14, which is elongated in the direction of a housing longitudinal axis A, has, for example, an essentially cylindrical configuration and is made, e.g., of sheet metal material. At both axial ends 16, 18, the circumferential wall 14 is connected in a gastight manner with a respective front wall 20, 22, for example, by connection in substance or/and by positive-locking connection. A first partition 24 and a second partition 26 are connected to the circumferential wall 14, for example, by connection in substance in an essentially gastight manner in length areas located between the two front walls 20, 22. The front walls 20, 22 and the partitions 24, 26 are preferably also made of sheet metal material.

An exhaust gas inlet generally designated by 28 comprises an inlet pipe 30, which is connected in an essentially gastight manner to the front wall 20 provided at the axial end area 16 of the circumferential wall 14, on the one hand, and to the first partition 24, on the other hand, and it provides in its interior an inlet duct 34 leading to a flow chamber 32. The inlet pipe 30 thus forms in the area of the front wall 20 an inlet opening of the exhaust gas inlet 28, which said inlet opening is open towards the inlet duct 34. In the area of the first partition 24, the inlet pipe 30 is open towards the flow chamber 32. It should be noted that the inlet pipe 30 ends in the area of the first partition 24 in the exemplary embodiment shown. This inlet pipe 30 could also extend beyond the first partition 24 into the flow chamber 32.

An exhaust gas outlet generally designated by 36 comprises an outlet pipe 38 connected in a gastight manner to the second partition 26, on the one hand, and to the front wall 22 provided at the axial end area 18 of the circumferential wall 14, on the other hand. An outlet duct 40, via which exhaust gas flowing through the flow chamber 32 can leave the exhaust muffler 10, is formed in the outlet pipe 38. In the area of the front wall 22, the outlet pipe 38 with its outlet duct 40 is open to the environment or to an area of an exhaust system following in the flow direction. In the area of the second partition 26, the outlet pipe 38 is connected to this partition 26 and is open towards the flow chamber 32. It should be noted here as well that, unlike as it is shown, the outlet pipe 38 could extend into the flow chamber 32 beyond the second partition 26. Further, it should be noted that both the inlet pipe 30 and the outlet pipe 38 may extend out of the muffler housing 12 via the front walls 20 and 22, respectively, which are connected to the inlet pipe 30, and the outlet pipe 38, in order to make it possible to facilitate a connection to areas of an exhaust system which follow upstream and downstream.

In the example shown, the inlet duct 34, the outlet duct 40 and the flow chamber 32 provide a flow volume 42 through which exhaust gas to be sent through the exhaust muffler can flow. In addition to this flow volume 42, two resonator chambers 44, 46 are integrated into the exhaust muffler 10.

The first resonator chamber 44, which is formed between the front wall 20 and the first partition 24, i.e., which is defined essentially axially by these walls, is associated with a first Helmholtz resonator 48. The second resonator chamber 46, which is formed between the second partition 26 and the front wall 22, i.e., which is defined essentially by these axially, is associated with a second Helmholtz resonator 50. The inlet pipe 30 passes in this case through the first resonator chamber 44, and the inlet pipe 30 does not provide an opening that is open towards the first resonator chamber 44, i.e., it is consequently closed with respect to this. The outlet pipe 38 passes through the second resonator chamber 46 and likewise has no opening that is open towards this, so that the outlet pipe 38 is basically closed against the second resonator chamber 46.

A resonator pipe generally designated by 52 is provided in the interior of the muffler housing 12. The resonator pipe 52 has basically three length areas 54, 56, 58 adjoining one another in the direction of the housing longitudinal axis A. The length area 54 of the resonator pipe 52, which length area is positioned approximately in the central part of the longitudinal area of the resonator pipe 52, provides an opening section 60, in which the resonator pipe 52 or a pipe interior formed therein is open via a plurality of pipe wall openings 64 provided in a pipe wall 62 of the resonator pipe 52 towards the flow chamber 32 and towards the flow volume 42. The pipe wall openings 64 may be arranged, for example, in a plurality of rows of openings extending in the direction of the housing longitudinal axis A in an essentially regular pattern of openings and thus establish in the circumferential direction of the pipe wall 62 of the resonator pipe 52 an essentially uniformly acting connection between the interior of the pipe and the flow chamber 32.

The length area 56 adjoining in an axial end area 66 of the opening section 60, which end area is located closer to the first partition 24, forms a first resonator neck 68 of the first Helmholtz resonator 48. The length area 56 or the first resonator neck 68 provided by this length area 56 passes through an opening in the first partition 24 and is preferably connected to this in an essentially gastight manner. In a first axial end area 70 of the resonator pipe 52, which end area 70 is positioned such that it meshes, extending beyond the first partition 24 in the example shown, with the first resonator chamber 44, the resonator pipe 52 or the first resonator neck 68 is open towards the first resonator chamber 44 and it provides in connection with this essentially the first Helmholtz resonator 48. In addition to the opening provided for or receiving the length area 56 of the resonator pipe 52, the first partition 24 has no additional openings establishing a connection between the first resonator chamber 44 and the flow volume or the flow chamber 32 thereof.

The length area 58 of the resonator pipe 52, which length area adjoins a second axial end area 72 of the opening section 60, passes through an opening in the second partition 26 and is connected to this preferably in an essentially gastight manner. The length area 58 forms a second resonator neck 74 and is open in the area of a second axial end area 76 of the resonator pipe 52 towards the second resonator chamber 46. The second length area 58 extends beyond the second partition 26, meshing with the second resonator chamber 46, and it provides in connection with this essentially the second Helmholtz resonator 50. This second partition 26 also has, in addition to the opening through which the resonator pipe 52 passes, no additional openings that provide a connection between the second resonator chamber 46 and the flow volume 42 or the flow chamber 32.

An acoustic connection of the two Helmholtz resonators 48, 50 or of the resonator necks 68, 74 thereof to the flow volume 42 or to the exhaust gas flowing through the flow volume 42 and generating sound is brought about via the pipe wall openings 64. Even though this exhaust gas will also fill the pipe interior of the resonator pipe 52, neither the volumes 44, 46 nor the pipe interior of the resonator pipe 52 participate in the exhaust gas flow, with the exception of the flow cross section 54 through which exhaust gas can basically flow, and therefore they shall not be considered to be a part of the flow volume in the sense of the present invention, either.

The resonance frequencies of the two Helmholtz resonators 48, 50 can be set and tuned in a defined manner to especially critical frequencies by the selection of the volumes of the two resonator chambers 44, 46, which volumes are limited essentially by the front walls 20, 22 and partitions 24, 26 axially limiting the resonator chambers 44, 46 as well as by the circumferential wall 14, and from which the volume occupied by the inlet pipe 30 and by the outlet pipe 38 shall always be subtracted, and by the correspondingly suitable dimensioning of the resonator necks 68, 74. It can be recognized now that with an especially simple structural configuration, the resonator pipe 52 is configured with essentially constant cross-sectional dimension, i.e., especially also with constant internal diameter in the direction of the housing longitudinal axis A, so that the particular resonance frequency of the Helmholtz resonators is influenced in the area of the resonator necks 68, 74 essentially by the suitable selection of the length thereof. This can, in turn, be brought about by the opening section 54 being arranged in a suitable positioning between the two axial end areas 70, 76 of the resonator 52, but within the axial extension of the resonator chamber 32 and also with a suitable extension in the direction of the housing longitudinal axis A. The longer the opening section 54 of the resonator pipe 52, the shorter is the still available length of the two length areas 56, 58 providing the resonator necks 68, 76.

Due to the fact that in the configuration according to the present invention, the two resonator chambers 44, 46 are arranged axially each directly adjoining the flow volume 42 through which the resonator pipe 52 passes, especially the flow chamber 32, an axially compact configuration is obtained, on the one hand, and it is made possible, on the other hand, for the single resonator pipe 52 to be able to provide the resonator necks 68, 74 associated with the two Helmholtz resonators 48, 50.

It should be noted in this connection that this can also be achieved if the flow volume has a plurality of flow chambers. For example, an additional partition, in which, for example, a connection is established between these chambers through one or more openings or/and one or more pipes pass through these, could be provided between the two partitions 24, 26, so that the exhaust gas flowing from the inlet 28 to the outlet 36 can flow through all these chambers. The opening section 54 could be arranged now in one of these chambers or it could be arranged located in both chambers or be divided into two areas, each of which is positioned in one of the flow chambers to be included in the flow volume 42. However, no additional partition dividing the flow volume 42 into a plurality of chambers is provided between the first partition 24 and the second partition 26 in the especially preferred type of configuration shown. The exhaust gas outlet could also have, for example, a plurality of outlet pipes, which would form, for example, respective tail pipes in this case.

While specific embodiments of the invention have been shown and described in detail to illustrate the application of the principles of the invention, it will be understood that the invention may be embodied otherwise without departing from such principles.

What is claimed is:

1. An exhaust muffler for an exhaust system of an internal combustion engine, the exhaust muffler comprising:

a muffler housing having a flow volume, through which exhaust gas flows, an exhaust gas inlet, an exhaust gas outlet, a first resonator chamber and a second resonator chamber; and a resonator pipe providing a first resonator neck and a second resonator neck, wherein the first resonator chamber is open to the flow volume via the first resonator neck and the second resonator chamber is open to the flow volume via the second resonator neck, the muffler housing comprising:

a circumferential wall elongated in a direction of a housing longitudinal axis;

a first front wall at a first axial end area of the circumferential wall;

a second front wall at a second axial end area of the circumferential wall;

a first partition between the front walls, wherein the first resonator chamber is separated from the flow volume by the first partition; and a second partition between the front walls, wherein the second resonator chamber is separated from the flow volume by the second partition, the exhaust gas inlet comprising an inlet pipe passing through one of the two resonator chambers and being open in an area of one of the two front walls and providing an inlet duct, the exhaust gas outlet comprising an outlet pipe passing through the other of the two resonator chambers and being open in an area of the other of the two front walls and providing an outlet duct.

2. The exhaust muffler in accordance with claim 1, wherein the flow volume comprises a flow chamber formed between the first partition and the second partition.

3. The exhaust muffler in accordance with claim 2, wherein:

the resonator pipe comprises a pipe wall opening in a pipe wall of the resonator pipe establishing a connection between the flow volume and a pipe interior of the resonator pipe in a pipe wall section extending in the flow volume;

the first resonator chamber is formed between one of the front walls and the first partition;

the second resonator chamber is formed between the other of the front walls and the second partition;

the resonator pipe passes through the flow chamber and is open with a first axial end area towards the first resonator chamber or/and is located in the first resonator chamber and is open with a second axial end area towards the second resonator chamber or/and is located in the second resonator chamber; and the resonator pipe has the at least one pipe wall opening in a pipe section extending in the flow chamber.

4. The exhaust muffler in accordance with claim 2, wherein:

the first resonator chamber is formed between one of the two front walls and the first partition;

the flow chamber is formed between the first partition and the second partition;

the second resonator chamber is formed between the second partition and the other of the two front walls; and the first resonator chamber, the flow chamber and the second resonator chamber are provided following one another in the direction of the housing longitudinal axis.

5. The exhaust muffler in accordance with claim 1, wherein:

the first resonator neck passes through the first partition or/and is open towards the first resonator chamber in an area of the first partition; and the second resonator neck passes through the second partition or/and is open towards the second resonator chamber in an area of the second partition.

6. The exhaust muffler in accordance with claim 5, wherein:

the first resonator neck has a first resonator neck opening providing a connection between the flow volume and the first resonator chamber and the first partition has no opening providing a connection between the flow volume and the first resonator chamber in addition to the first resonator neck opening; and the second resonator neck has a second resonator neck opening providing a connection between the flow volume and the second resonator chamber and the second partition has no opening providing a connection between the flow volume and the second resonator chamber in addition to the second resonator neck opening.

7. The exhaust muffler in accordance with claim 1, wherein:

the first resonator chamber is formed between one of the front walls and the first partition;

the second resonator chamber is formed between the other of the front walls and the second partition.

8. The exhaust muffler in accordance with claim 1, wherein:

the inlet pipe is open towards the flow volume in an area of the partition separating one of the two resonators chambers from the flow volume; and the outlet pipe is open towards the flow volume in an area of the partition separating the other of the two resonator chambers from the flow volume.

9. The exhaust muffler in accordance with claim 1, wherein the resonator pipe comprises a pipe wall opening in a pipe wall of the resonator pipe establishing a connection between the flow volume and a pipe interior of the resonator pipe in a pipe wall section extending in the flow volume.

10. The exhaust muffler in accordance with claim 9, wherein:

the pipe wall opening is one of a plurality of pipe wall openings provided in a resonator pipe opening section of the pipe wall; and the resonator pipe opening section extends in the flow volume.

11. The exhaust muffler in accordance with claim 10, wherein:

the resonator pipe provides the first resonator neck in a first length area adjoining the pipe opening section at a first axial end area of the pipe opening section; and the resonator pipe provides the second resonator neck in a second length area adjoining the pipe opening section at a second axial end area of the pipe opening section.

12. The exhaust muffler in accordance with claim 1, wherein the first resonator chamber and the second resonator chamber have mutually different resonator chamber volumes, or/and the first resonator neck and the second resonator neck have mutually different resonator neck lengths.

13. The exhaust muffler in accordance with claim 1, wherein the resonator pipe has a constant cross-sectional dimension over an entire length thereof.

14. An exhaust muffler for an exhaust system of an internal combustion engine, the exhaust muffler comprising:

a muffler housing having a flow volume, through which exhaust gas flows, an exhaust gas inlet, an exhaust gas outlet, a first resonator chamber and a second resonator chamber; and a resonator pipe providing a first resonator neck and a second resonator neck, wherein the first resonator chamber is open to the flow volume via the first resonator neck and the second resonator chamber is open to the flow volume via the second resonator neck, the muffler housing comprising:

a circumferential wall elongated in a direction of a housing longitudinal axis;

a first front wall at a first axial end area of the circumferential wall;

a second front wall at a second axial end area of the circumferential wall;

a first partition between the front walls, wherein the first resonator chamber is defined by the first partition and the first front wall and is separated from the flow volume by the first partition;

a second partition between the front walls, wherein the second resonator chamber is defined by the second partition and the second front wall and is separated from the flow volume by the second partition;

a flow chamber of the flow volume defined by the first partition and the second partition, wherein at least one of:

the exhaust gas inlet comprises an inlet pipe passing through one of the two resonator chambers and providing an inlet duct open to the flow chamber in an area of one of the two partitions; and the exhaust gas outlet comprises an outlet pipe passing through the other of the two resonator chambers and providing an outlet duct open to the flow chamber in an area of the other of the partitions.

15. The exhaust muffler in accordance with claim 14, wherein:

the inlet pipe passing through the one of the two resonator chambers and providing the inlet duct is open to the flow chamber in the area of the one of the two partitions; and the outlet pipe passing through the other of the two resonator chambers and providing the outlet duct is open to the flow chamber in the area of the other of the partitions.

* * * * *